US006840584B2

(12) United States Patent
Rocheford

(10) Patent No.: US 6,840,584 B2
(45) Date of Patent: Jan. 11, 2005

(54) FURNITURE BACKING SUPPORT

(75) Inventor: Michael D. Rocheford, Dayton, MN (US)

(73) Assignee: The Upholstery Studio, Inc., Brooklyn Park, MN (US)

( * ) Notice: Subject to any disclaimer, the term of this patent is extended or adjusted under 35 U.S.C. 154(b) by 0 days.

(21) Appl. No.: 10/254,062

(22) Filed: Sep. 20, 2002

(65) Prior Publication Data

US 2003/0107256 A1 Jun. 12, 2003

Related U.S. Application Data

(60) Provisional application No. 60/323,945, filed on Sep. 21, 2001.

(51) Int. Cl.[7] ..... A47C 5/12

(52) U.S. Cl. ..... 297/451.6; 297/452.16; 297/411.41

(58) Field of Search ..... 297/452.16, 452.17, 297/451.5, 451.6, 411.41, 440.1; 119/28.5

(56) References Cited

U.S. PATENT DOCUMENTS

| | | | | | |
|---|---|---|---|---|---|
| 1,780,570 | A | * | 11/1930 | Stephens | 297/411.41 |
| 2,430,241 | A | * | 11/1947 | Nicholas | 297/118 |
| 2,478,236 | A | * | 8/1949 | Carr | 297/487 |
| 2,546,811 | A | * | 3/1951 | Anderson | 297/331 |
| 2,693,227 | A | * | 11/1954 | Holland | 297/188.09 |
| 3,438,676 | A | * | 4/1969 | Brosk | 297/451.6 |
| 4,131,314 | A | * | 12/1978 | Knapp et al. | 297/248 |
| 4,387,927 | A | * | 6/1983 | Fahey | 297/451.5 |
| 5,136,981 | A | * | 8/1992 | Barreto et al. | 119/28.5 |
| 5,588,393 | A | * | 12/1996 | Heilborn | 119/28.5 |

* cited by examiner

*Primary Examiner*—Peter Brown
(74) *Attorney, Agent, or Firm*—Nawrocki, Rooney & Sivertson, P.A.

(57) ABSTRACT

An article of furniture made of a quasi-rigid foam material. The furniture includes a base for sitting thereon. A back support member is wrapped around the base such that a portion of the support member extends upwardly with respect to the base. The support member has a pair of ends that wrap around at least half of a cylindrical surface of the base to translate a force from an upwardly extending portion of the support member to the ends and prevent tearing of the support member from the base.

14 Claims, 3 Drawing Sheets

FURNITURE BACKING SUPPORT

CROSS-REFERENCE TO RELATED APPLICATIONS

This is a regular application filed under 35 U.S.C. §111(a) claiming priority, under 35 U.S.C. §119(e)(1), of provisional application Ser. No. 60/323,945, previously filed Sep. 21, 2001 under 35 U.S.C. §111(b).

FIELD OF THE INVENTION

The present invention relates generally to the field of furniture. More specifically, the present invention relates to chairs and, more particularly, to chairs which can be used by children.

BACKGROUND OF THE INVENTION

The chair and other such articles of furniture for sitting thereon are well known and can come in many shapes, styles, sizes, and forms. Most articles of furniture comprise, at least in part, some type of rigid material such as wood, and even padded or cushioned chairs tend to have a rigid frame of some sort. Many of such chairs are intended exclusively for use by adults.

It is, in some situations, desirable that children sit on cushioned furniture so as to minimize the possibility of injury. Additionally, it is advantageous for children to have smaller furniture to fit their smaller size. Since children are likely to cause wear and tear on furniture, it is also advantageous to make a more durable furniture for use by children.

One common problem with chairs for children is that a child will often try to lean back with great force, and, eventually, a tear or break of a chair support backing may result. This can cause injury to the child.

It is to these problems and dictates of the prior art that the present invention is directed.

SUMMARY OF THE INVENTION

It is an object of the present invention, therefore, to provide an article of furniture, such as a chair, that is made of a durable material which is not fully rigid.

It is a further object of the present invention to provide furniture, such as a chair, that has an improved back structure support.

It is a further object of the present invention to provide furniture, such as a chair, that is simple and cost efficient to manufacture.

The present invention is a chair having a sitting member and a back support member. In a preferred embodiment, the back support member can form a partial boundary about the sitting member by providing a back engaging portion and a pair of arm rests.

The chair sitting member comprises of a base which is surrounded by the back support member. The base is made of a material which is not fully rigid but having sufficient density to allow one to sit comfortably thereon. On top of the base is a seat portion which defines a sitting surface.

The back support member comprises a lamina of quasi-rigid material that wraps around the sitting member. The back support member extends upwardly with respect to the sitting member forming the back engaging member and arm rests.

Wrapping the back support member around at least half of the sitting member affords a measure of rigidity to the back engaging member and arm rests. A person sitting on the chair can apply backward force against the back engaging member without breaking or tearing the back support member away from the sitting member. As the person leans back in the chair, the force will be transmitted to the front of the chair, where the forward ends of the back support member are secured to the sitting member and cause the arm rests to curve inwardly towards the child.

DETAILED DESCRIPTION OF THE PREFERRED EMBODIMENTS

Figure 1:
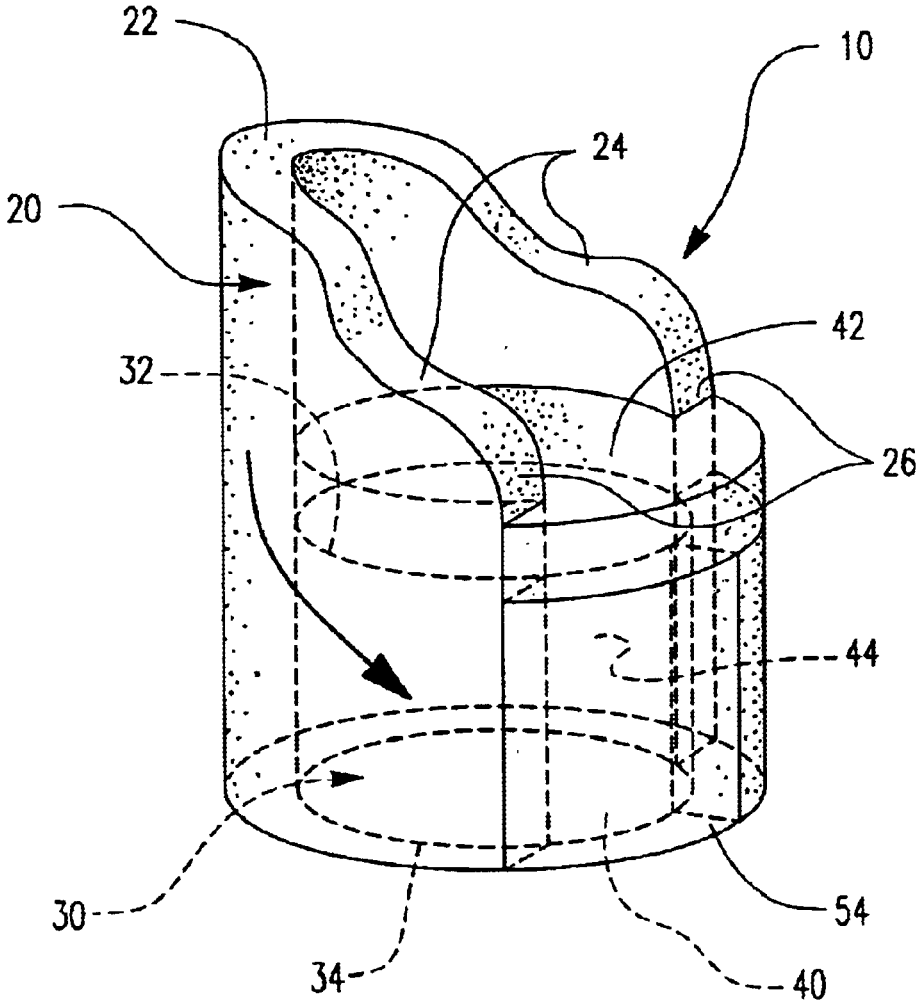
FIG. 1 is a perspective view of the present invention.

FIG. 1 illustrates an article of furniture for supporting an occupant. The article of furniture can be used by a child. A sitting member 30 includes a base 40 which supports a seat portion 42 for receiving an occupant thereon. A back support member 20 is secured to a cylindrical surface of the base 40, and extends upwardly with respect to the seat portion 42 and the base 40 to form a back engaging portion 22 and a pair of armrests 24. The base 40 and support member 20 are made of a material having a limited degree of rigidity. A material contemplated by the present invention is a foam that is capable of supporting an occupant. The support member 20 is secured to the base 40 such that the occupant may lean back against the support member 20, and the force will be transferred to the ends 26 of the support member 20. The force helps to support the occupant as a result of the armrests 24 moving inwardly toward the occupant.

The base 40 has a top surface 32 supporting the seat portion 42, a bottom surface 46 and a cylindrical surface 44 between the ends of the base 40. The base 40 is made of a single material for simplicity of construction.

The back support member 20 has first and second ends 26. The ends 26 are able to be wrapped around at least a portion of the cylindrical surface 44 of the base 40. At least a portion of the back support member 20 extends upwardly with respect to the seat portion 42 to define upright back engaging portion 22 for providing rear support to an occupant. The ends 26 are secured to the cylindrical surface 44 to enable an occupant to lean securely against the back support member 20.

As illustrated, the support member 20 wraps around at least half of the cylindrical surface 44 of the base 40. This facilitates additional support to an occupant leaning against the support member 20. The force of the occupant on the support member 20 is translated to ends 26 of the support member 20. The material draws the arm rests 24 inwardly to better support the occupant in response to the leaning force.

The embodiment shown in the figures has a generally cylindrical base 40, as previously described. It is envisioned that the base 40 be shaped for use in a variety of articles of furniture. It is contemplated that the base 40 may have an elongate seat portion to form a sofa or a chaise lounge. It is further contemplated that the back support member 20 wrap around at least half of the surface 44 of the base 40 in any of these contemplated variations of the present embodiment. The back support member 20 may extend upwardly with respect to the seat portion to define back engaging portion 22 and armrests 24.

The seat portion 42 positioned on the base 40 and the back engaging portion 22 of the back support member 20 define a sitting cavity for receiving an occupant. The back engaging portion 22 need not be perpendicular to the seat portion 42. The portion 22 merely need extend generally upwardly with respect to the seat portion 42. The sitting area has a cavity for receiving an occupant.

The portion 22 of the back support member 20 has an upper edge defining its shape. As illustrated in FIG. 1, the portion 22 has a pair of armrests extending laterally therefrom. The upper edge defines the upper extremity of portion 22. The upper edge may be curved, as illustrated, angled, linear or any combination of the above.

The seat portion may be made of any material suitable for sitting thereon. It may be shaped to fit on the base 40 and to conform with the wrapped around support member 20.

The base 40 and support member 20 may be covered with a fabric covering. The seat portion 42 may also be covered with a fabric. The fabric may cover the entire base 40 and support member 20, or it may cover only a portion of the base 40 and support member 20.

The quasi-rigid material contemplated by the present invention may be a foam. It is contemplated that the foam density be between about 1.45 pounds per cubic foot and about 1.55 pounds per cubic foot. It is further contemplated that the foam have an indentation force deflection(I.F.D.) between about 63 I.F.D.(lbs.) and about 77 I.F.D.(lbs.).

Figure 2:
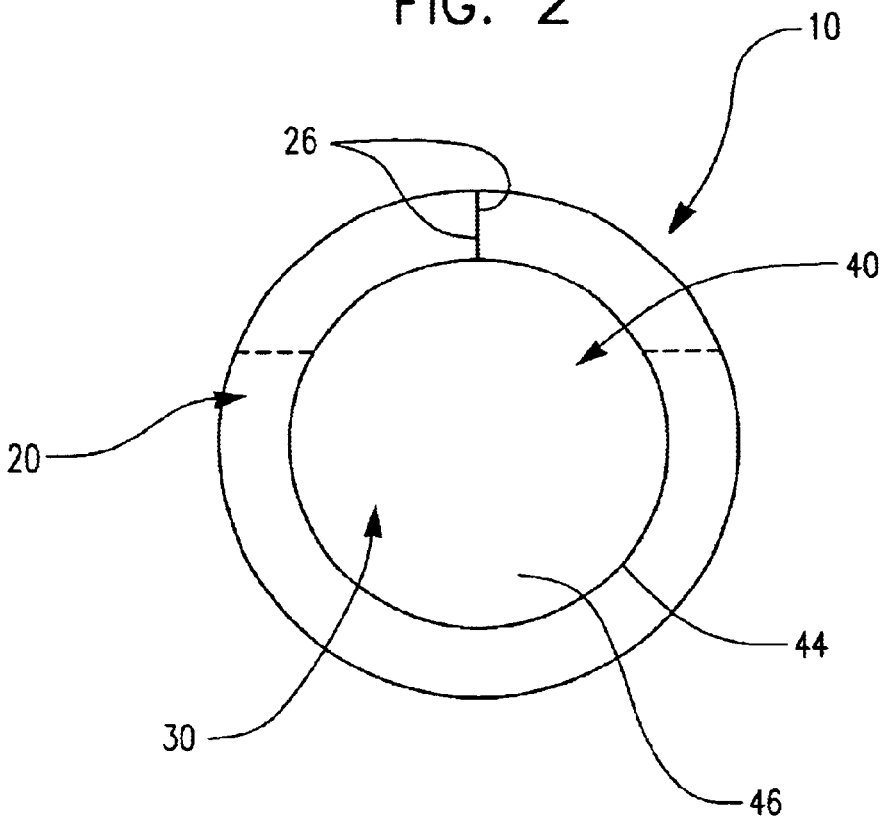
FIG. 2 is a bottom plan view of the apparatus of FIG. 1.
Figure 3:
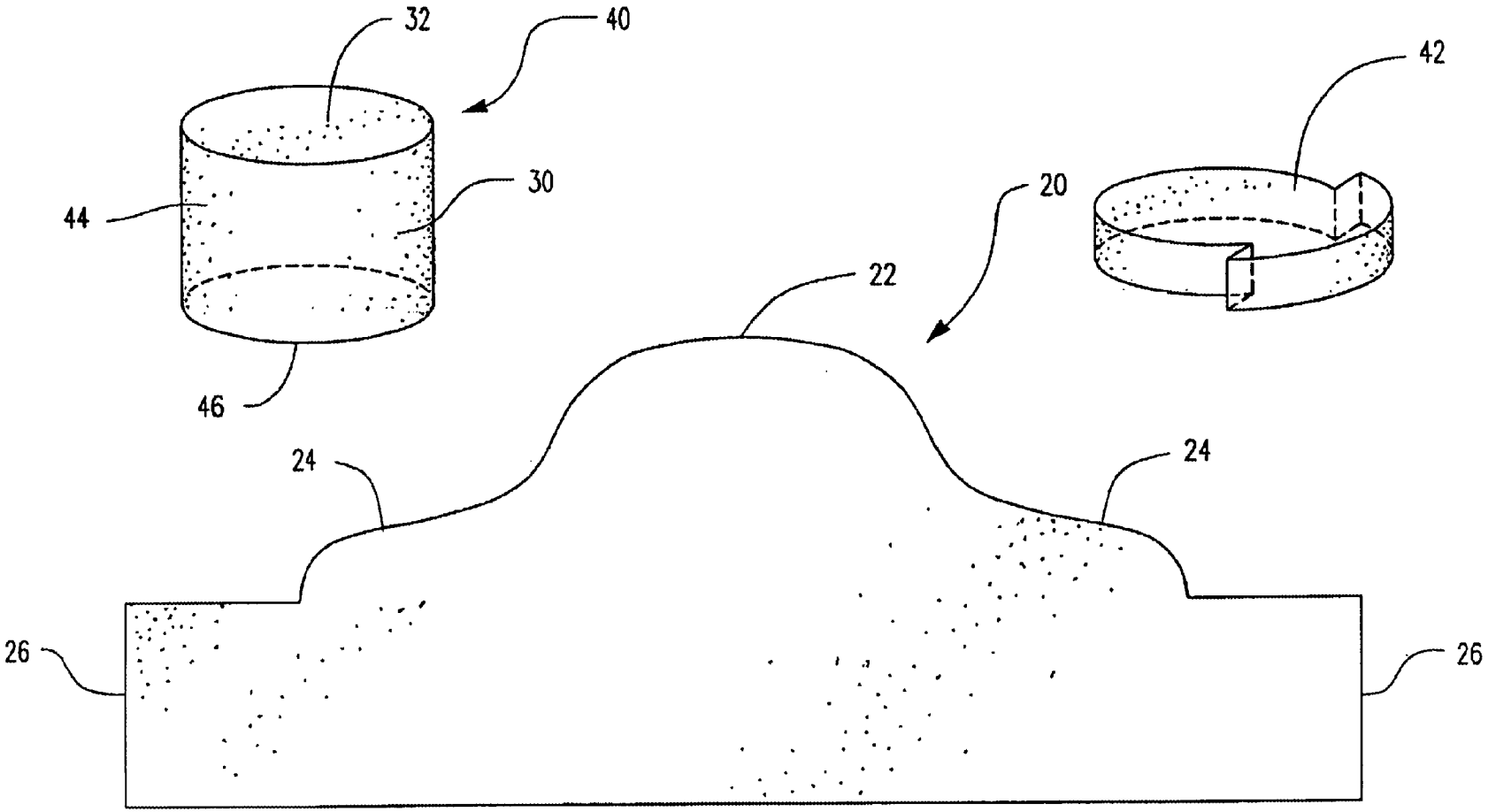
FIG. 3 is an exploded-type view of the apparatus of FIG. 1.

FIG. 2 illustrates the bottom of the chair shown in FIG. 1. The base 40 has a bottom surface 34. The support member 20 has ends that wrap around the base 40. As illustrated, the support member 20 wraps around at least half of the base 40. A portion of the surface 44 may not be covered by the support member 20. This would leave a space between the ends 26 of the support member 20. A piece of material may be placed between ends 26 of the support member 20. It is contemplated that one or more pieces may be fitted to complete circumvention of the base 40 between ends 26 of the support member 20. It is further contemplated that the support member 20 may extend around the entire base 40 such that ends 26 substantially engage each other.

In the present invention, the support member 20 is intended to wrap at least 180° around the base 40. It is preferable that the support member 20 wrap around the base 40 from about 200° to about 260° in order to provide adequate support to the occupant. The support member 20 may wrap 360° around the base 40 such that ends 26 engage each other. The portion 22 and armrests 24 of the support member 20 may wrap around the seat portion 42 about 200°. The support member 20 may have a thickness of about 3 inches. The support member 20 is secured to the base 40 with foam adhesive.

It will be understood that this disclosure, in many respects, is only illustrative. Changes may be made in details, particularly in matters of shape, size, material, and arrangement of parts without exceeding the scope of the invention. Accordingly, the scope of the invention is as defined in the language of the appended claims.

What is claimed is:

1. A chair, comprising:

a sitting member including a base, made entirely from a quasi-rigid material, which is formed from a foam having a density between 1.45 and 1.55 pounds per cubic foot and an indentation force deflection between 63 and 77 pounds, having a generally vertically extending enclosing surface; and a back support member defined by a lamina made entirely from said quasi-rigid material, said back support member being wrapped around at least half of said generally vertically extending enclosing surface.

2. The chair of claim 1 wherein said generally vertically extending enclosing surface of said base is substantially cylindrical.

3. The chair of claim 2 wherein said back support member includes a back engaging portion extending upwardly from an upper surface of said base.

4. The chair of claim 3 wherein said back support member includes a portion wrapped around between 200° and 260° of said generally cylindrical enclosing surface.

5. The chair of claim 3 further comprising a seat portion positioned on an upper surface of said base.

6. A chair, comprising:

a sitting member including a base, made from a quasi-rigid material, which is formed from a foam having a density between 1.45 and 1.55 rounds per cubic foot and an indentation force deflection between 63 and 77 pounds, having a generally vertically extending enclosing surface wherein said generally vertically extending enclosing surface of said base is substantially cylindrical;

a back support member defined by a lamina of said quasi-rigid material, said back support member being wrapped around at least half of said generally vertically extending enclosing surface wherein said back support member includes a back engaging portion extending upwardly from an upper surface of said base; and, wherein said back support member includes a portion wrapped around substantially 360° of said generally vertically extending enclosing surface.

7. An article of furniture, comprising:

a base having a generally vertically extending enclosing surface;

a seat portion positioned on said base; and a back support member secured to said enclosing surface of said base and wrapped around a portion of said surface, a portion of said back support member extending upwardly with respect to said seat portion;

wherein said base, seat portion and back support member are made entirely of a quasi-rigid material, which is formed from a foam having a density between 1.45 and 1.55 pounds per cubic foot and an indentation force deflection between 63 and 77 pounds.

8. The article of furniture of claim 7 wherein said back support member has ends secured to said enclosing surface of said base.

9. The article of furniture of claim 8 wherein said back support member wraps around at least half of said enclosing surface of said base.

10. The article of furniture of claim 8 further comprising a fabric covering at least a portion of said base and said support member.

11. The article of furniture according to claim 10 wherein said fabric covering extends across a joint between said base and said support member.

12. The article of furniture according to claim 7 wherein said portion of said support member extending upwardly with respect to said seat portion defines a pair of arm rests.

13. The article of furniture according to claim 12 wherein an upper edge of said support member is non-linear claims 1, 5 and 7 have been amended, claim 17 has been added.

14. An article of furniture, comprising:

a sitting member including a base, made from a quasi-rigid material, having a generally vertically extending enclosing surface;

a back support member defined by a lamina of quasi-rigid material, which is formed from a foam having a density between 1.45 and 1.55 pounds per cubic foot and an indentation force deflection between 63 and 77 pounds, said back support member being wrapped around at least half of said generally vertically extending enclosing surface; and, wherein said back support member includes a portion wrapped around substantially 360° of said generally vertically extending enclosing surface.

* * * * *